United States Patent [19]

Walther et al.

[11] 4,195,447

[45] Apr. 1, 1980

[54] VIBRATION ABRASIVE CONTAINER

[75] Inventors: Carl K. Walther, Wuppertal; Henning D. Walther, Haan; Hubert P. Hagelüken, Düsseldorf; Karl Temme, Wuppertal, all of Fed. Rep. of Germany

[73] Assignee: Carl Kurt Walther GmbH & Co. KG, Wuppertal, Fed. Rep. of Germany

[21] Appl. No.: 902,484

[22] Filed: May 3, 1978

[30] Foreign Application Priority Data

| | | | |
|---|---|---|---|
| May 14, 1977 | [DE] | Fed. Rep. of Germany | 2721943 |
| May 14, 1977 | [DE] | Fed. Rep. of Germany | 2721944 |
| May 14, 1977 | [DE] | Fed. Rep. of Germany | 2721945 |
| Jan. 12, 1978 | [DE] | Fed. Rep. of Germany | 2801180 |
| Mar. 20, 1978 | [DE] | Fed. Rep. of Germany | 2812070 |

[51] Int. Cl.[2] ..... B24B 31/00

[52] U.S. Cl. ..... 51/163.2; 366/114

[58] Field of Search ..... 366/114; 51/163.1, 163.2, 51/7; 241/175

[56] References Cited

U.S. PATENT DOCUMENTS

| | | | |
|---|---|---|---|
| 3,429,560 | 2/1969 | Huber | 51/163.2 |
| 3,618,267 | 11/1971 | Huber et al. | 51/163.2 |
| 3,906,679 | 9/1975 | Riedel | 51/163.2 |
| 4,001,979 | 1/1977 | Elkins | 51/163.2 |

FOREIGN PATENT DOCUMENTS

| | | | |
|---|---|---|---|
| 2339367 | 3/1974 | Fed. Rep. of Germany | 51/163.2 |

*Primary Examiner*—Harold D. Whitehead
*Attorney, Agent, or Firm*—Martin A. Farber

[57] ABSTRACT

A channel formed vibration abrasive container with a channel surrounding, in a non-circular longitudinal course, a centrally disposed vibration generator, to which channel there is coordinated a selectively operative discharge- and separation- device. The channel course comprises two 180° curved arcs disposed opposite each other at a distance, which arcs are arranged in symmetrical position relative to the vibration generator and are connected with each other by two parallel extending linear channel sections.

12 Claims, 9 Drawing Figures

Figure 1:
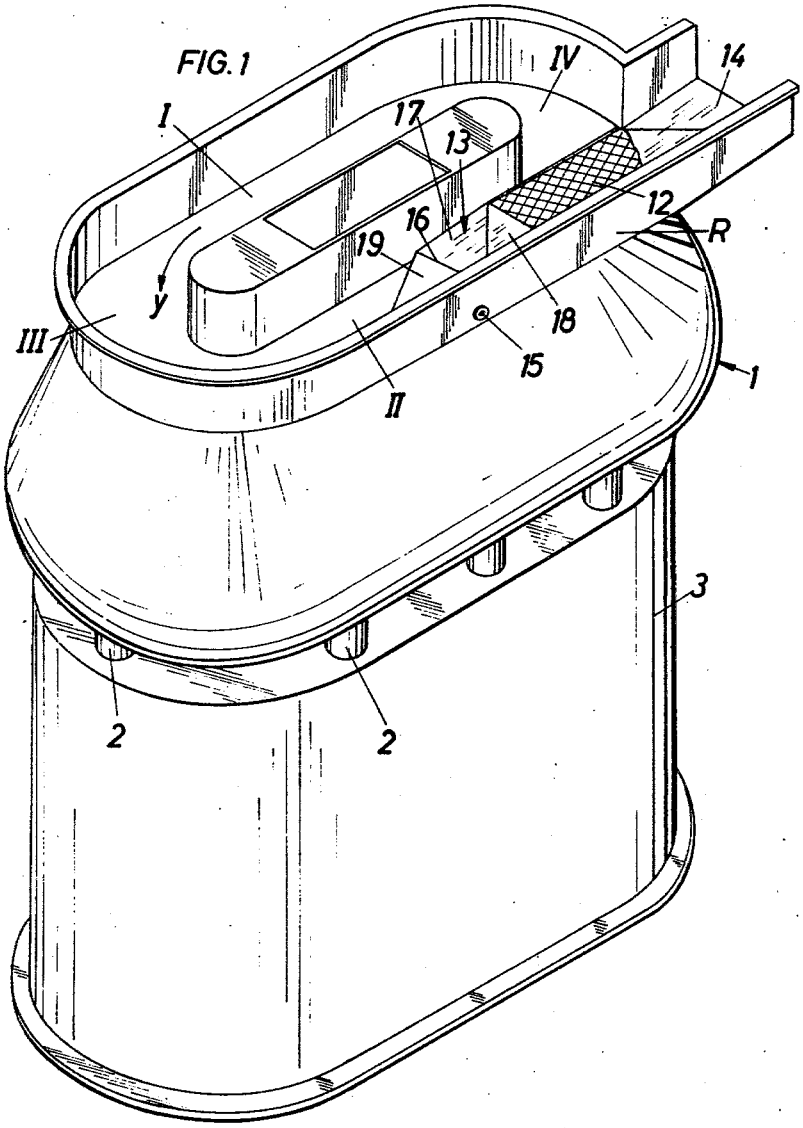

1
IV
14
17
13
12
R
16
19
y
18
III
15
1
II
3
2
2

17
20
V
13
23
7
R
15
x
17
10
1
21
16
19
13
α
9
21
8
5
20
V
A
A
R
22
11
B
C
6
x
2
3
4 z
1'
26
Ka
Ki
25
24

24

1''
29
27
28

24
1'''
30
31

VIBRATION ABRASIVE CONTAINER

The invention relates to a channel-shaped vibration-abrasive container with a channel in a non-circular longitudinal course surrounding a centrally disposed vibration generator, to which channel there is coordinated an alternately working discharge- and separation-device.

A vibration abrasive container is known by German Pat. No. 1 652 058, which seen in ground plan view has at least one break, whose break angle is smaller or equal to 90°. It deals with a drop-shaped, tablet- or pastille-shaped triangular and square plan form. All these forms are disadvantageous in working technique and also for the installation of several devices in series or in a row.

The task on which the subject matter of the present invention is based is to make a vibration abrasive container of the previously set forth type in a construction of simpler production technique and more advantageous use, which not only for the series formed installation of several containers has a most favorable form, but as a result of the channel course about the vibration generator also guarantees an optimum operating circulation with higher grinding or cutting action.

This task is solved in the manner that the channel course comprises two 180° curved arcs oppositely spaced apart, which are arranged in symmetrical position relative to the vibration generator and are connected with each other by two parallel extending linear channel sections.

Important to the execution in accordance with the present invention is the arena-shaped (or more precisely stadium-shaped) plan layout of the vibration abrasive container. The spacing difference of the individual channel cross-sections from the vibration producer, which spacing difference leads to an amplitude change, can be varied in a considerable degree, without this bringing a change of the channel cross-section in the individual sections. Consequently in the 180° curved arcs which lie spaced opposite and in the linear channel sections connecting the latter there is guaranteed an uninterrupted circulation movement of the container contents. After that the arena-(stadium) shaped plan layout of the vibration abrasive container in addition to the large variation of the spacing difference with constant channel cross-section brings space saving advantages with respect to a series- or row-formed installation of several vibration abrasive containers in one factory hall or the like. A favorable ratio exists between the installation or mounting surface and the channel length with economical space utilization. The arena (stadium) shape makes it possible for the length of the linear sections, passing therethrough by the container contents with helically-shaped circulation, to be able to be nearly exactly as long as the curved stretch. This brings optimum working ratios. Then it allows the arena-shaped plan layout of the vibration abrasive container to accommodate in its longitudinally extended inner space, not only one but several vibration generators. For example it is possible to provide two vibration generators, the distance of which from one another then can still be varied. In this manner different vibrations are transmitable to the vibration abrasive container, which considerably increases the range of use of such an arena-shaped vibration abrasive container.

An advantageous further formation in accordance with the present invention resides in that on the linear section, viewed in the passage direction of the container contents, lying one after another there is disposed a per se known separation screen with a flap prearranged to the latter and the linear section continues on the upper container edge into a discharge spout. The linear section brings favorable prerequisites for the accommodation of the selective discharge- and separating-device comprising the flap and separating screen. The discharge spout arranged after this is able to be produced merely by lengthening of the upper container edge of the linear section, whereby altogether low production costs for the vibration abrasive container in accordance with the invention can be realized.

Beyond that it is favorable that the channel cross-section comprises two cross-sectional partial surfaces which are angular relative to one another. The alignment of the cross-section partial surfaces with the curved arcs as well as with the linear channel sections thereby is the same, so that no change occurs with respect to the channel cross-section. The inclined extending channel cross-section receives the container contents. By the inclined alignment, a delay is achieved with the circulation movement of the container contents, which increases the operating intensity on the entire plan form of the container. This leads to shorter surface working or finishing times and to a larger economy of the vibration abrasive container. Finally it is still advantageous in addition that the container inner and outer-wall are acute angled, inclined relative to the vertical such that the centrifugal weight plane of rotation cuts the channel outer wall into another distance from the channel vertex line than the inner wall. Parts of the container contents thus also with unfavorable operating conditions do not jump or come out of the vibration abrasive container. Moreover the outer wall which partially covers the container contents leads to a control of the circulation movement of the container contents. The inner space which has the vibration producer is well accessible, e.g. for adjustment of the centrifugal weights.

As a result of the different course of the connection line of the springs and the container contour, a further increase of the operating performance is attained. To the contrary of the known constructions of the same order of size, with equally injected power or load, the surface working or finishing time is shortened. The different size spacings of the container in at least two cross-sectional planes which are perpendicular relative to one another lead to a change of the vibration amplitude and consequently of the circulation movement of the container contents, which leads to an elevated operating intensity. It allows the most different geometrical forms to combine by or from the contour line of the container and the connection line of the springs. An advantageous embodiment according to the invention resides in that the diameter of the circularly-shaped connection line of the springs corresponds approximately to the smallest diameter of the arena figure. The support of the arena-shaped container thus occurs in its center range. Only the curved zones of the container project over the connection line of the springs. In this range the deviation in the circulation movement of the container contents occurs. Since in this section there also extends the screen stretch, there results a perfect separation of the workpieces from the treatment means. Tests have proven that best operating results exist when the smallest and largest diameters of the arena container have a ratio of approximately 1:2. Moreover contributing to an increased operational intensity is that the largest projection over the circular connection line of the springs amounts to somewhat more than the annular channel width. Thereby it is of advantage that the width of the channel amounts to approximately one-third of the smallest arena diameter. There exists in this manner a balanced ratio, so that in this range of measure the best operating results are obtained.

Figure 2:
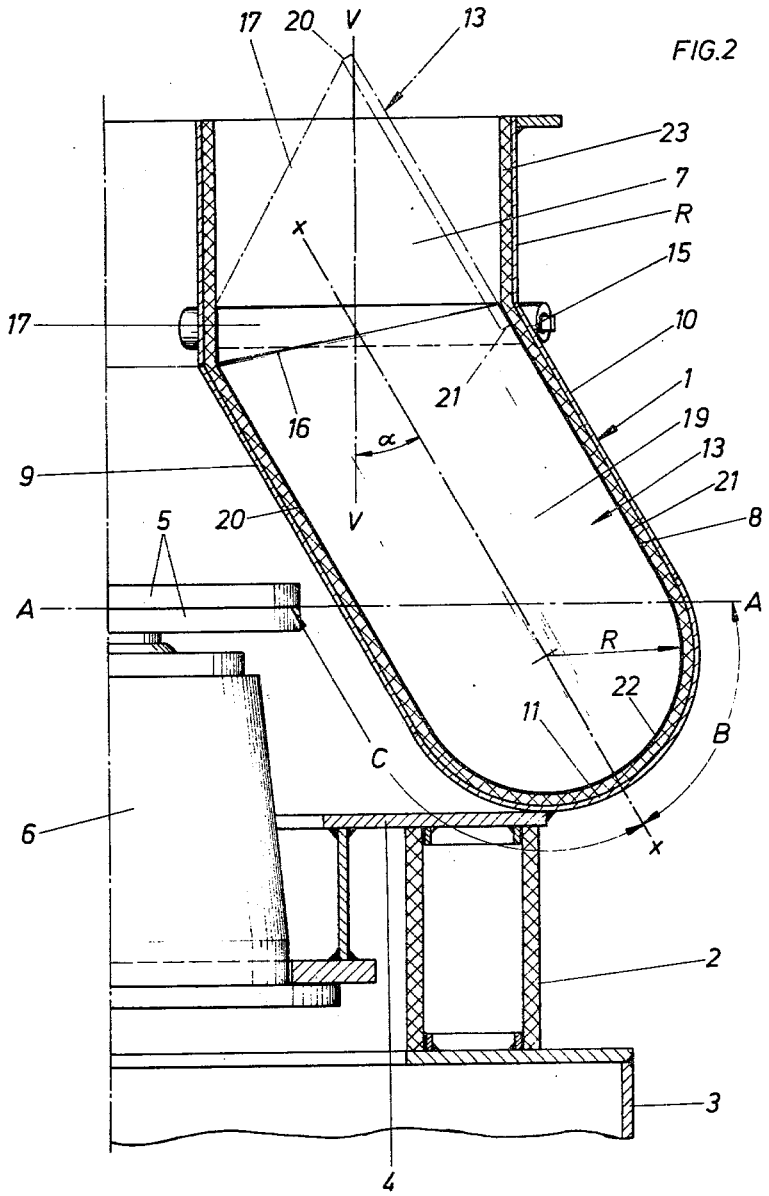
Figure 3:
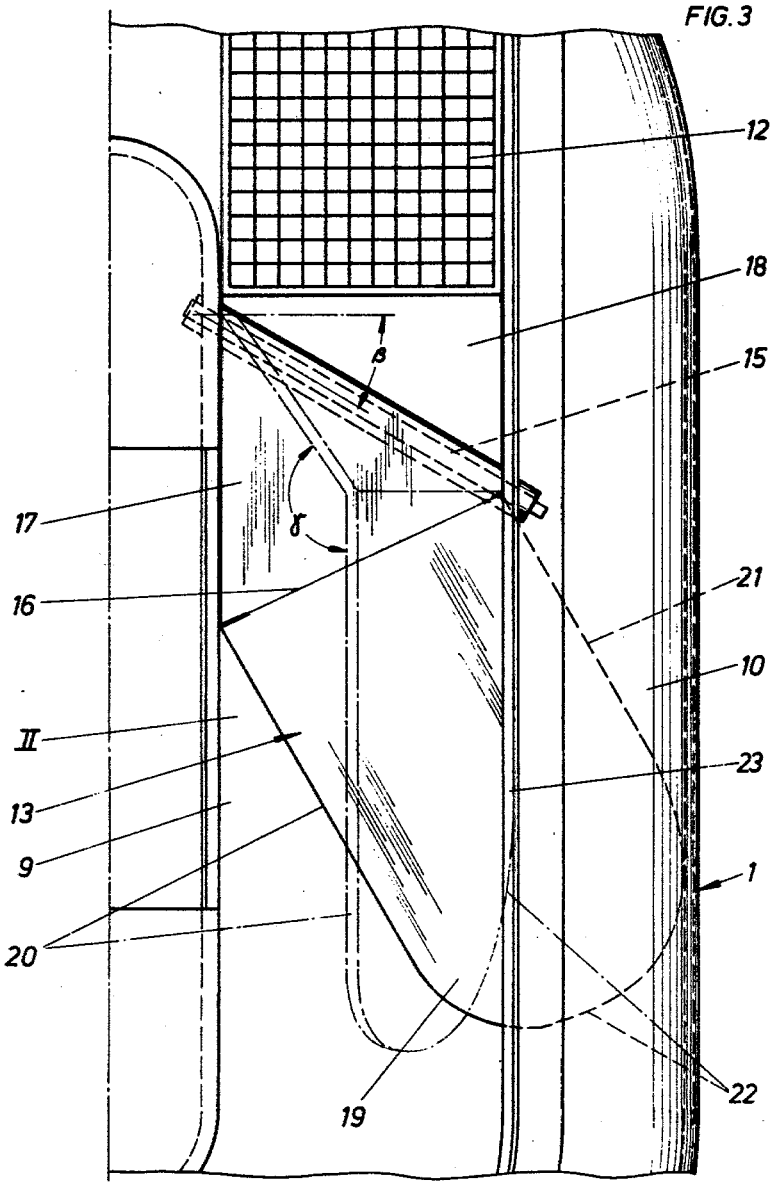
Figure 4:
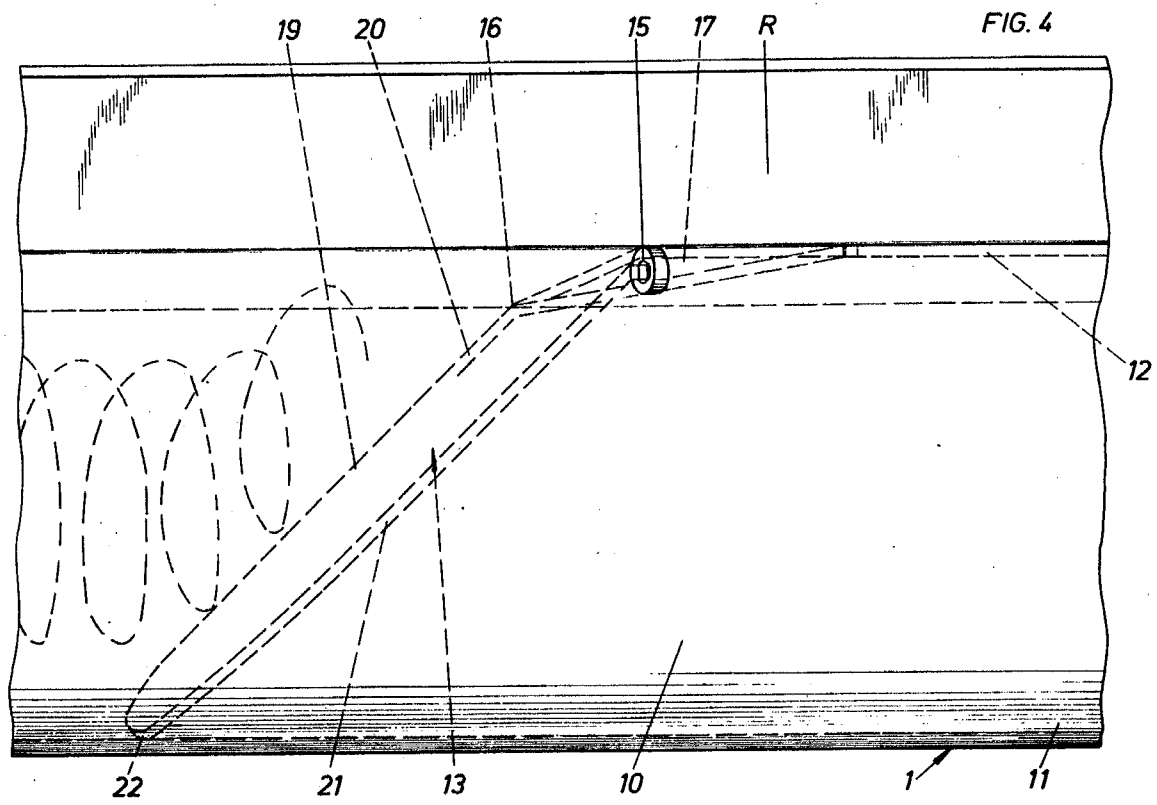
Figure 5:
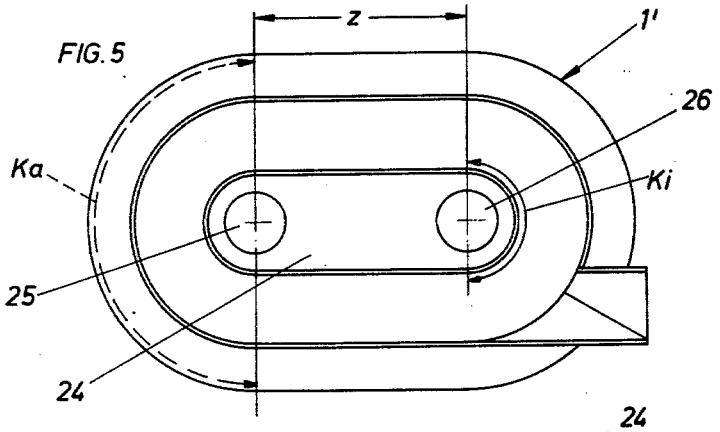
Figure 6:
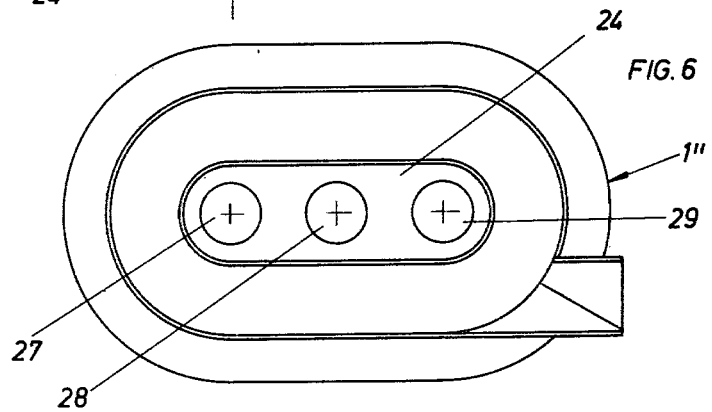
Figure 7:
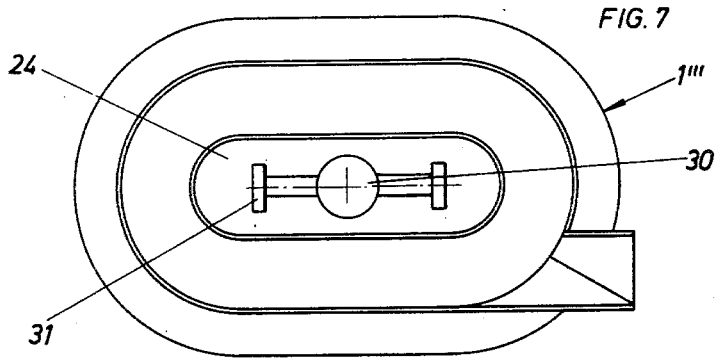
Figure 8:
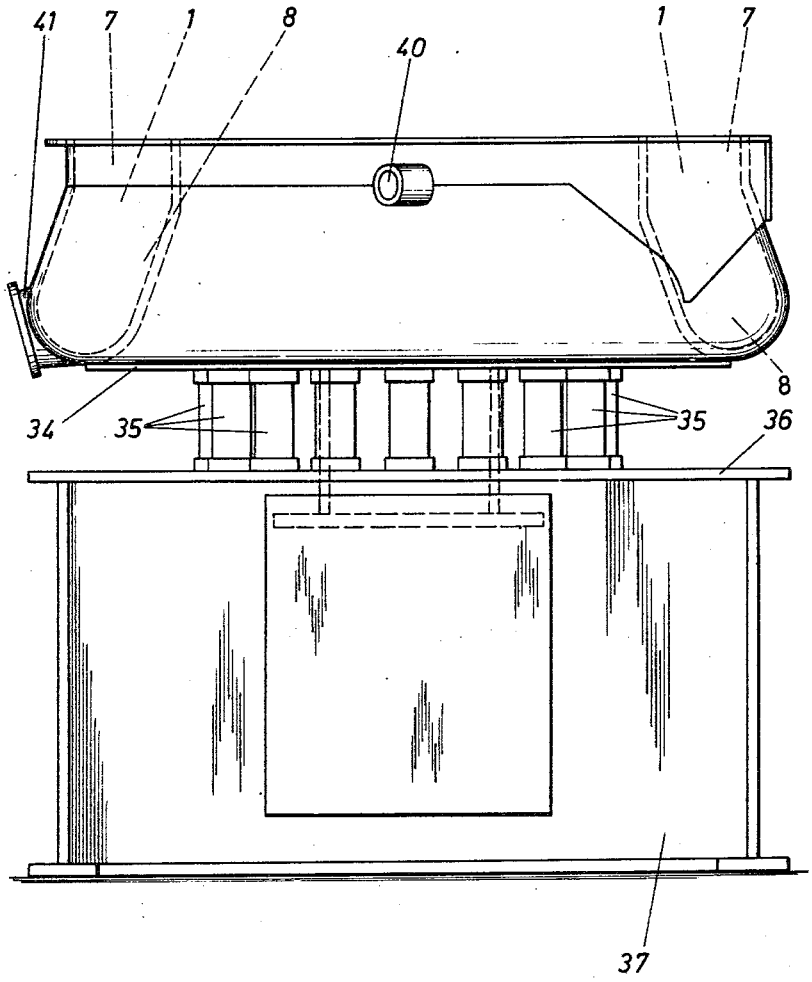
Figure 9:
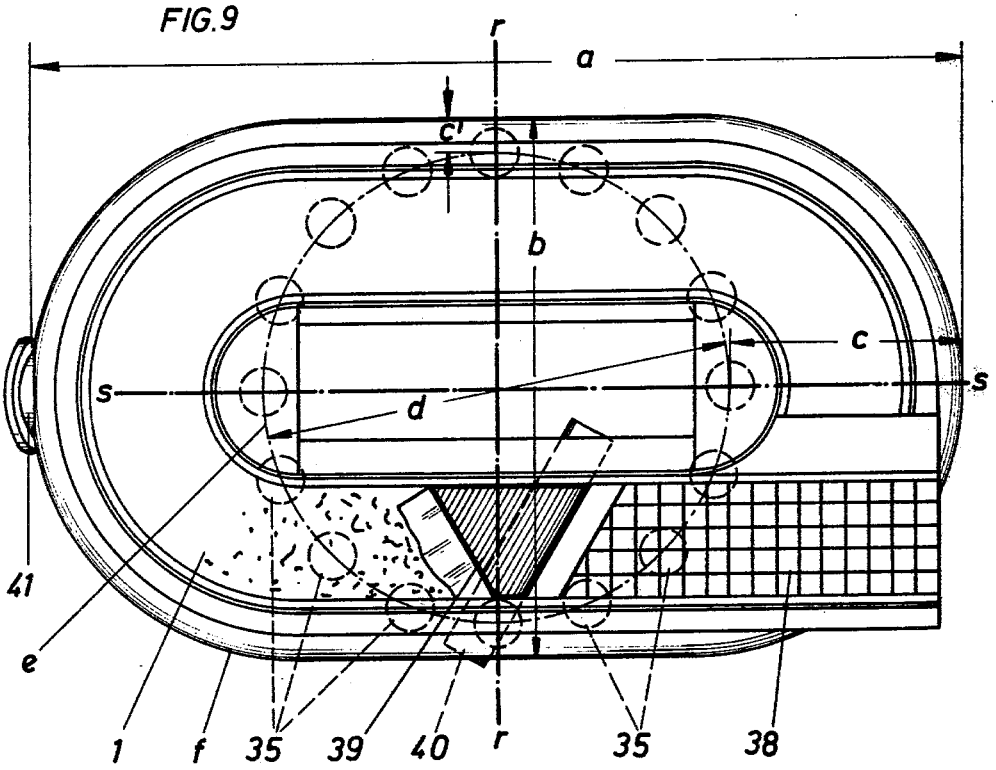

Several embodiment examples of the invention are explained on the basis of FIGS. 1–9. There shows:

FIG. 1 in perspective illustration is an arena-shaped vibration abrasive container with discharge and separation device accommodated in the linear section, FIG. 2 is a cross-section through the vibration abrasive container in the region in front of the flap, FIG. 3 is a top plan view of the vibration abrasive container with flap located in the discharge position, FIG. 4 is a side view toward the vibration abrasive container in the region of the flap, FIG. 5 is schematic ground plan illustration is an arena-shaped vibration abrasive container with two equal vibration generators accommodated in the inner space of the container, FIG. 6 is an illustration corresponding to FIG. 5, however with three vibration generators, FIG. 7 is the vibration abrasive container in ground plan with two different formed vibration generators, FIG. 8 is a view of an arena-shaped vibration abrasive container with springs arranged on a circular connection line and FIG. 9 is the top plan view of the vibration abrasive container.

The vibration abrasive container which is formed arena-shaped in plan layout is supported on the base support or pedestal 3 by means of the spring elements 2. A carrier body 4 which is fastened on the bottom side of the vibration abrasive container 1 receives the motor 6, the latter having the centrifugal weights 5.

The vibration abrasive container 1 which is illustrated in cross-section in FIG. 2 comprises two cross-sectional partial surfaces 7 and 8 which are angular relative to one another. The cross-sectional partial surface 7 is vertically aligned, whereas the channel vertex line x—x of the cross-sectional partial surface 8 defines an acute angle alpha with the cross-section partial surface 7.

The cross-sectional partial surfaces 7, 8 are bound by the inner wall 9 and the outer wall 10. The channel bottom or floor 11 has a semi-circular shaped course.

As FIG. 2 shows, the plane of rotation A—A of the centrifugal weight cuts the channel outer wall 10 at the distance B from the channel apex line x—x. The channel inner wall 9 to the contrary is cut at a distance C from the channel apex line x—x. Due to the inclined alignment of the cross-section partial surface 8 of the channel cross-section the distance C is larger than the distance B.

The channel course comprises two linear channel sections I and II, which are connected with one another by the 180° curved arcs III and IV which lie spaced opposite. The passage or running through direction of the container contents is indicated with y. This stadium channel is run through by the container contents (workpieces plus cutting or grinding bodies) is continuous circulation in a spiral-shaped circulation movement, (see dashed spiral lines in FIG. 4). The length z of the linear sections I and II corresponds approximately to the length of the curved stretches III and IV.

In the special case the length in the range of the curving inner wall Ki indeed is smaller than a straight stretch I and II, respectively, and the length on the curving outer wall Ka is larger than the straight stretch I and II, respectively.

The selectively operative discharge and separation -device extends in the linear section II. This device possesses the separation screen 12 which is horizontally aligned, arranged spaced from the channel floor 11 (note FIG. 4). The flap 13 is arranged in front of the separation screen 12. The linear section II continues on the upper container edge R into a discharge spout 14. The flap 13 is swung-in when after repeated or multiple circulation, the workpieces should be discharged.

The container channel is formed equal in cross-section in the vicinity of the linear channel arcs III, IV as well as in the vicinity of the linear channel sections I and II.

The flap axle 15 which lies approximately at the height of the separation screen 12 runs in the horizontal, inclined relative to the channel cross-section, and indeed at an angle beta. Between the flap axle 15 and the upper, flap surface edge 16 there extends an approximately triangularly-formed wedge 17. This wedge stands with swung-in flap 13 approximately horizontally and at the height of the separation screen 12. Between the flap axle 15 and the separation screen 12 there is disposed a triangularly-shaped spacer member 18, which constitutes the over-bridge between the separation screen 12 and the wedge 17. The flap surface 19 is connected on the edge 16 of the flap surfaces at an obtuse angle gamma. This flap surface 19, with a swung-in flap 13, runs inclined relative to the container cross-section. The flap 13 is provided such that its side edges 20, 21 and its front edge 22 engage or lie on the inner walling of the container in the discharge position illustrated with full lines. The same is formed from a rubber cover or casing 23 or the like.

If the flap is supposed to be moved from its discharge position into the dot-dashed line position according to FIGS. 2 and 3, the flap axle 15 is to turn in the clockwise direction, whereby the flap 13 emerges from the container contents by means of or over its side edge 20. With this swinging-out, the flap 13 executes a superimposed tilting movement reducing the transverse position of the flap plane relative to the channel cross-section, which permits a force or energy conserving swinging-out of the flap 13. FIG. 2 indicates in dot-dashed lines that in the swung-out position of the flap 13, the flap surface 19 lies substantially parallel to the outer wall 10 of the channel.

If the flap 13 is supposed to be brought into the discharge position, the flap axle 15 is to turn in the counterclockwise direction. In this manner the side edge 21 first submerges into the container contents. Dependent upon the helical movement of the container contents directed outwardly to inwardly, the further swinging-in of the flap is accelerated until it steps into engagement to the container wall.

In FIG. 2 it is illustrated that the channel vertex line x—x of the cross-sectional partial surface 8 climbs from the lower right to the upper left. The cross-sectional partial surface however can be aligned also such the channel vertex line climbs from the lower left to the upper right. This version permits a space saving construction with respect to the height, since then a larger region of the container cross-section can be arranged underneath the centrifugal weights.

The vibration abrasive container 1', which is illustrated in ground plan in FIG. 5, receives in its inner space 24 two vibration generators 25 and 26, which are arranged spaced from one another. These vibration generators are formed the same in their construction. On the other hand they are accommodated such that their spacing z is variable.

The vibration abrasive container 1'' which is illustrated in FIG. 6 shows three vibration generators 27, 28, 29 which are accommodated in the inner space 24. Here likewise a spacing variation of the two outer vibration generators 27, 29 could be provided.

In FIG. 7 likewise two vibration generators 30 and 31 are accommodated in the inner space 24 of the vibration abrasive container 1'''. This deals hereby with vibration generators arranged one above the other of different construction.

The vibration abrasive container illustrated in FIGS. 8 and 9 possesses an stadium-shaped contour form. The ratio of the smallest diameter b relative to the largest diameter a of the arena container amounts to approximately 1:2.

The cross-sectional shape of the annular channel 1 is evident from FIG. 8. This comprises the two cross-sectional partial surfaces 7 and 8 which are angular relative to one another. The cross-sectional partial surface 7 is vertically aligned, whereas the cross-sectional partial surface 8 runs inclined outwardly directed and has a rounded channel bottom or floor.

A base plate 34 is fastened on the channel bottom, on which base plate the springs 35 are supported. The springs 35 in turn are carried by the cover plate 36 of the machine pedestal or support 37. As particularly to be seen from FIG. 9, diameter d of the connection line e of the springs corresponds substantially to the smallest diameter b of the stadium container.

Nevertheless the connection line e of the springs 35 differs or deviates from the contour line f of the stadium channel. FIG. 9 indicates that the container projects in cross-section planes r—r and s—s, which planes are perpendicularly relative to one another, by different size distances c, c', over the connection line of the springs 35. In this case the largest projection over the circular shaped connection line e of the springs is somewhat more than the channel width.

Only the curving zones of the stadium-shaped abrasive container project extensively over the connection line e of the springs. In this range a change of the vibration amplitude occurs and consequently a deviation in the circulation movement, which brings therewith the increased operating performance or efficiency.

In one of the linear sections of the stadium-shaped vibration abrasive container there extends the selectively operative discharge and separation device. This possesses the separation screen 38, which is horizontally aligned, arranged spaced from the channel bottom, and the flap 39 which is prearranged to the screen 38. The largest part of the separation screen 38 extends in the vicinity on the other side of the connection line e of the springs. The flap axle 40 which lies substantially at the level of the separation screen 38 runs in the horizontal, inclined relative to the conveying direction. A connection piece 41 extends from the curved arc that lies opposite to the separation screen 38, in order to be able to completely empty the vibration abrasive container upon need.

We claim:

1. A channel formed vibration abrasive container comprising walls including sides and a bottom forming a channel and defining a complete stadium shaped channel course of unperforated form, at least one vibration generator centrally disposed relative to said complete stadium shaped channel and vibratingly operatively connected to said walls, said channel surrounding said vibration generator in a non-circular longitudinal course, a selectively operative discharge- and separation-means being coordinated to said channel for selectively passing container contents unimpeded throughout said complete channel during an abrasive vibratory working phase and selectively for discharging and separation passage thereover only when actuated to then stop complete circulation through said channel, said walls defining the channel course comprising two pure 180° curved arcs disposed opposite each other at a distance, said curved arcs being arranged in symmetrical position relative to said vibration generator, and said walls defining the channel course further comprising two parallel extending linear channel sections connecting smoothly said curved arcs with each other.

2. The vibration abrasive container according to claim 1, wherein the length of each of the linear channel sections is approximately equal to that of each of said curved arcs.

3. The vibration abrasive container according to claim 1, wherein said curved arcs each include a curved linear wall and a curved outer wall defining a portion of said channel therebetween, the length of said curved inner wall is smaller than the length of one of said linear channel sections, respectively, and the length of said curved outer wall is larger than the length of one of said linear channel sections, respectively.

4. The vibration abrasive container according to claim 1, wherein said means further comprising, a separation screen disposed in one of said linear channel sections spaced above said bottom, a portion of said channel being defined between said bottom and said separation screen, a flap pivotally mounted in said one linear channel section in a passage direction in said channel of the container contents disposed upstream in front of said separation screen, such that in one position of said flap said channel portion is closed and the container contents run up said flap to said separation screen, a discharge spout, said walls have an upper container edge and said one linear channel section continues downstream of said separation screen on said upper container edge into said discharge spout.

5. The channel formed vibration adhesive container as set forth in claim 4, further comprising a flap axle mounted in said walls horizontally inclined relative to the channel cross-section, a substantially triangularly-formed wedge connected to said axle and an edge of said flap, said wedge being approximately horizontal in said one position of the flap closing said channel portion, said flap having side edges and a front edge engaging the sides and bottom of said walls in said one position with said flap inclined relative to the channel cross-section, said flap having a flap surface substantially parallel to another of said walls in another position of said flap opening said channel portion, a stationary triangularly shaped spacer member disposed between said separation screen and said flap axle.

6. The vibration abrasive container according to claim 1, wherein said walls defining said channel in cross-section comprise two cross-sectional partial surfaces which are angular relative to one another.

7. The vibration abrasive container according to claim 1, wherein said vibration generator includes rotatably mounted centrifugal weights defining a plane of rotation thereof, said walls include a container inner wall and a container outer wall which are acute angled and inclined relative to the vertical and define a vertex line of said channel therebetween, said plane of rotation of said centrifugal weights cuts said outer wall into a different distance from said vertex line than said plane of rotation cuts said inner wall from said vertex line of said channel.

8. A vibration abrasive container with a resiliently supported stadium-shaped channel, comprising a support, container walls defining a stadium-shaped channel having an outermost contour line, said channel constituting means for exclusive abrasive vibratory working of workpieces therein without discharge, a plurality of springs disposed on said support defining an imaginary connection line defined through the centers of said springs, said connection line of said springs deviates from said outermost contour line of said channel such that in at least two cross-sectional planes through said stadium-shaped channel oriented perpendicularly relative to one another, said container walls project by different distances beyond said connection line of said springs.

9. The vibration abrasive container according to claim 8, wherein said contour line has the form of a stadium defining a smallest and largest diameter, and said connection line of said springs is circularly-shaped and defines a diameter which corresponds approximately to the smallest diameter of the stadium form.

10. The vibration abrasive container according to claim 9, wherein said smallest and said largest diameters of the stadium form have a ratio of approximately 1:2.

11. The vibration abrasive container according to claim 9, wherein the largest projecting distance of said walls over the circularly-shaped connection line of the springs is somewhat greater than the width of said annular channel.

12. The vibration abrasive container according to claim 9, wherein the width of said channel amounts to approximately one-third of the smallest diameter of the stadium form.

* * * * *